United States Patent [19]

Klowak et al.

[11] 4,125,659

[45] Nov. 14, 1978

[54] PATTERNED CREPING OF FIBROUS PRODUCTS

[75] Inventors: Bernard G. Klowak, Neenah; Walter L. Pauls, Appleton, both of Wis.; Frederick J. Vermillon, Jr., Stamford, Conn.

[73] Assignee: American Can Company, Greenwich, Conn.

[21] Appl. No.: 691,305

[22] Filed: Jun. 1, 1976

[51] Int. Cl.[2] ..... D21H 5/24; B31F 1/12

[52] U.S. Cl. ..... 428/153; 156/183; 156/474; 162/112; 162/113; 264/283

[58] Field of Search ..... 156/183, 291, 474; 162/111, 112, 113; 264/282, 283; 125/152, 153

[56] References Cited

U.S. PATENT DOCUMENTS

| | | | |
|---|---|---|---|
| Re. 17,633 | 4/1930 | Rowe | 264/283 |
| 1,143,333 | 6/1915 | Tompkins et al. | 162/111 |
| 1,196,181 | 8/1916 | Tompkins et al. | 162/113 |
| 3,014,832 | 12/1961 | Donnelly | 264/283 |
| 3,301,746 | 1/1967 | Sanford et al. | 162/113 |
| 3,537,954 | 11/1970 | Justus | 162/113 |
| 3,812,000 | 5/1974 | Salvucci, Jr. et al. | 162/111 |
| 3,903,342 | 9/1975 | Roberts, Jr. | 156/183 |

*Primary Examiner*—William A. Powell
*Assistant Examiner*—Michael W. Ball
*Attorney, Agent, or Firm*—Robert P. Auber; George P. Ziehmer; Ira S. Dorman

[57] ABSTRACT

A fibrous web is uniformly adhered to the surface of a smooth creping cylinder or other creping surface without causing substantial compression of the web. A raised pattern is pressed into the web toward the creping cylinder to cause the portions of the web that are pressed to adhere more strongly to the creping surface, while the portions of the web that are not pressed remain more lightly adhered to the creping surface. The web is creped from the creping surface with a creping blade, and the resulting product has a pattern creped appearance wherein the portions of the web that are pressed are finely creped while the portions of the web that were not so pressed are coarsely creped.

15 Claims, 7 Drawing Figures

PATTERNED CREPING OF FIBROUS PRODUCTS

BACKGROUND OF THE INVENTION

1. Field of the Invention

This invention pertains generally to methods and apparatus for the forming of pattern-creped fibrous products, and to the resulting creped fibrous products.

2. Description of the Prior Art

One method that has commonly been employed to break up the inter-fiber bonds in a formed web is by creping the web, usually as it comes off a drying drum which may be a Yankee dryer. In the typical creping operation, the web is pressed with a smooth roller onto a heated polishd metal drum, such as the Yankee dryer, while it is partially wet and before final drying. The heat of the dryer cylinder and the pressing with the roller causes the web to adhere to the surface of the cylinder as the moisture in the web is evaporated, with the dried web creped off the cylinder by a doctor blade.

The conventional creping process prepares the web for creping by pressing the web onto the dryer cylinder with a smooth roller. In addition, the prior art has recognized to some extent that variations in the creped paper product can be achieved by operations on the web while adhering the web to the cylinder, or by operations on the web while on the cylinder. As illustrated by the Tompkins et al. patent, U.S. Pat. No. 1,196,181, the prior art has recognized that a paper web can be water-marked by pressing the web with a watermark pattern while on a drying cylinder. Another Tompkins et al. patent, U.S. Pat. No. 1,143,333, taught that pressing the web while on the cylinder with a pressure roll having annular projections results in the pressed portions of the web having greater strength than the unpressed portions.

In the Sanford patent, U.S. Pat. No. 3,301,746, the web is pressed onto the drying cylinder with a knuckled fabric to achieve increased adhesion in the spot pattern of the knuckles. A similar knuckled fabric is pressed into a paper web after the web has been adhered to the drying cylinder in the Justus patent, U.S. Pat. No. 3,537,954. The prior art has also recognized that the creping can be affected through the patterned application of a bonding and adhering agent, in British patent specification No. 1,294,794, issued to the Scott Paper Company.

SUMMARY OF THE INVENTION

We have invented a method for pattern creping of a fibrous web such as paper and non-wovens which can produce products having desirable characteristics of softness and an attractive appearance, while maintaining necessary tensile stength. Our method includes the step of uniformly adhering the fibrous web to a smooth creping cylinder without causing substantial compression of the web. Particularly in the case of adhering a substantially dry web, the method can include the step of uniformly applying an adhesive between the web and the creping cylinder to aid in the adhering of the web to the creping cylinder. The adhesive can be applied through such means as an offset roll or spraying apparatus, for applying a uniform coating of adhesive either to one side of the web prior to adherence to the creping cylinder or to the creping cylinder prior to adherence of the web. The fibrous web is uniformly adhered to the smooth creping cylinder without causing substantial compression of the web, through such means as contacting the web without external pressure assistance to the surface of the cylinder for adherence, or through light pressing of the web onto the cylinder for adherence. In the case of adhering an initially substantially dry web with the assistance of the adhesive, we have found that while the web undergoes a relatively small amount of rewetting upon being contacted with the adhesive, the total moisture content of the web including the moisture added by the adhesive can be kept to less than 20% by weight of the web.

After the web has been adhered to the creping cylinder, a raised pattern is pressed into the web toward the creping cylinder. This may be accomplished, for example, by the use of a patterned surfaced impression roller or a patterned surfaced endless belt. In either case, the raised pattern makes pressure contact with the web to produce patterned areas of pressure on the web, causing such areas of the web to become more firmly adhered to the creping surface. This step can also be said to cause the web to be differentially adhered to the cylinder since the pressed areas of the web are adhered more firmly than the unpressed areas. As the web comes into contact with the creping blade, the areas that are more firmly adhered to the creping surface are more finely creped into numerous dense folds, whereas the portions of the web which are less strongly adhered to the creping surfaces are creped coarsely or not at all. The result is a succession of alternate folds or pleats on a very small scale generally following the pattern which has been impressed on the web.

The pressing of the raised pattern into the web toward the creping cylinder forms regions of the web enclosed by compressed linear portions, pressed by the raised pattern, having directional components extending axially and circumferentially of the cylinder. Since these linear portions have been pressed, these portions have greater adhesion to the cylinder than the unpressed portions. The actual pattern design for pressing can take numerous forms and, for example, can include a pattern wherein the compressed linear portions of the web having greater adhesion to the cylinder are uninterrupted.

The pattern creping of a fibrous web by our invention affects the strength and bulk properties of the creped fibrous product. Pressing the fibrous web on the cylinder with the raised pattern serves to compress the pressed portions of the web. The extent to which the compression of the web results in any lasting modification to the web is dependent on such factors as web makeup and consistency, and the degree of pressing employed. The pressing may generally result in stronger fibrous bonding and reduced bulk while on the cylinder at the portions of the web corresponding to the impression pattern and will result in greater adhesion at those portions of the web. The remainder of the web area will be essentially unaffected in terms of web bulk or strength. Upon creping, therefore, the pressed and unpressed areas of the web will be subjected to differing creping forces with differing overall results in bulk and strength, depending upon such aspects as the web, fiber composition, and extent of crepe.

DESCRIPTION OF THE PREFERRED EMBODIMENTS

Figure 1:
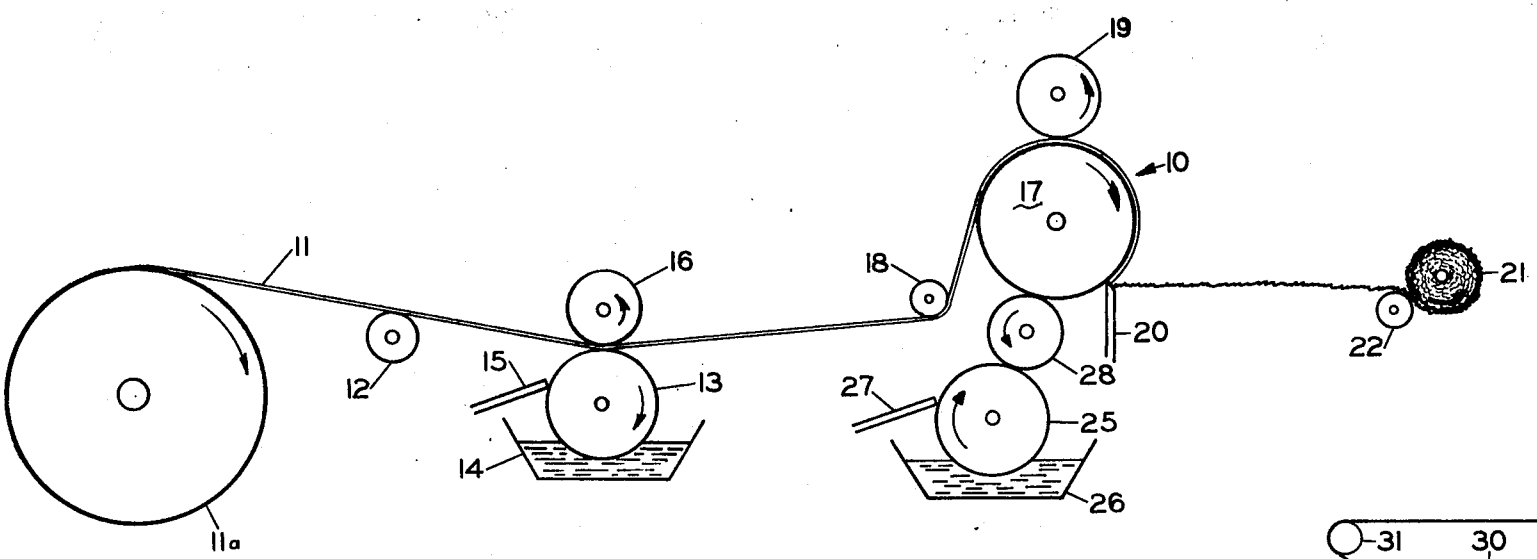
FIG. 1 is a schematic view of creping apparatus utilized in performing patterned creping on a fibrous web, showing two alternatives for applying adhesive.

Apparatus suitable for performing our patterned creping method is shown generally at 10 in FIG. 1. The creping apparatus 10 is most conveniently utilized to perform the creping operation on a fibrous web 11 which is fed continuously to the apparatus. It is, of course, also possible to perform such a creping operation with sheets of fibrous web by utilizing sheet feeding and stacking apparatus (not shown).

The web 11 may be composed exclusively of cellulosic fibers formed in the usual way to produce a paper product, or the web may be of a different form, such as composed of nonwoven cellulosic fibers interspersed with stronger synthetic fibers. The web 11 as shown in FIG. 1 is provided from a roll of finished paper 11*a* after final drying, with less than 10% moisture content. The present invention can also be utilized as a step in a continuous web-making process and for webs of greater moisture content.

The web 11 coming off the roll 11*a* is supported by a roller 12 which feeds the web into contact with a rotogravure adhesive applicator roller 13. The rotogravure roller picks up a liquid adhesive from a pan 14 and carries the adhesive upward on its surface as it revolves into contact with one side of the web 11. A doctor blade 15 is provided to scrape or wipe off excess adhesive and ensure that the surface of the roller 13 is uniformly covered with the adhesive liquid. Adequate application of adhesive fluid to the web can be obtained by laying the web onto the gravure roller. As shown in FIG. 1, a backup roller 16 can be provided which contacts the other side of the web and presses the web into contact with the gravure roller 13. The contact between the roller 16 and the gravure roller 13 provides uniform contact pressure between these two rollers on the web, thereby allowing the adhesive to be applied to the web in a uniform coat throughout the length of the web. The pressure at the nip between the backup roller and the gravure roller is selected to be just sufficient to provide proper transfer of the adhesive. Excessive pressure is preferably avoided to prevent substantial reduction in thickness of the web.

The adhesive may be applied to one surface of the web by other well known methods, such as spraying or wiping the adhesive onto the web without employing a roller. The gravure roller has the advantage of being capable of applying a very uniform thin coating of adhesive to the web.

The side of the web with the adhesive coating thereon is advanced into contact with the surface of a revolving creping cylinder 17 preferably without the assistance of a pressure roller. If a pressure roller is used to assist in adhesion of the web to the cylinder, minimum pressure should be applied to avoid substantial compression of the web. The cylinder 17 may be of the common Yankee dryer type, which has a highly polished metal surface and which may be heated internally. Heating of the dryer surface is desirable since it allows the solvent in the adhesive to be quickly dried on the surface of the cylinder. Heating may also be desirable to dry excess moisture from the web prior to creping.

The slack in the web between the adhesive applicator roller 13 and the creping cylinder 17 is reduced by a take-up roller 18. The take-up roller 18 also allows for adjustment of the contact tension between the web and the creping cylinder 17. The force exerted on the web by the take-up roller 18 is sufficient to pull the adhesive coated web into contact with the surface of the creping cylinder 17, thus providing uniform adherence of the fibrous web to the creping cylinder without the need for external pressing of the web onto the cylinder.

As the creping cylinder 17 revolves, the web is brought into engagement with a pattern roller 19 which has raised portions thereon defining a pattern. This raised pattern on the roller 19 is pressed into the web toward the surface of the creping cylinder 17. The portions of the web that are so pressed are more strongly adhered to the surface of the creping roller than are the areas of the web which have not been pressed against the surface of the creping cylinder. To ensure that the web is pressed only in the patterned portions, the raised portions on the roller 19 should be of a height greater than the thickness of the paper web. The pattern roller surface is preferably made of rubber to provide some resiliency in the contact between the pattern roller and the creping surface. Hard metal roller surfaces may also be employed if the contact pressure is carefully controlled.

Further rotation of the creping cylinder 17 brings the paper web adhered to the surface of the creping cylinder into contact with a creping doctor blade 20. The doctor blade 20 causes the web to be creped off the surface of the creping roller in the manner described below. The fully creped web is then wound up on a wind-up reel 21, with the winding of the web being assisted by a guide roller 22.

Figure 3:
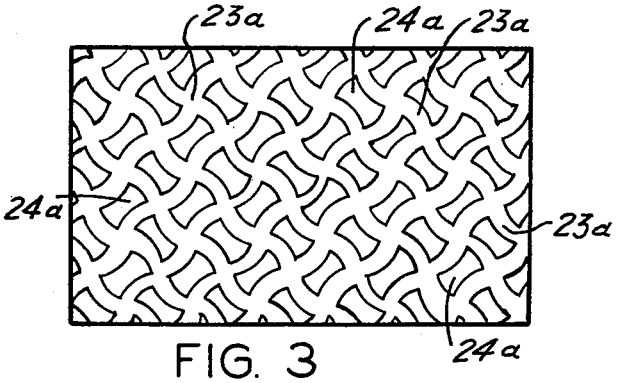
FIG. 3 is a plan view of a portion of a pattern surface which can be used to provide patterned areas of pressure on a fibrous web.
Figure 4:
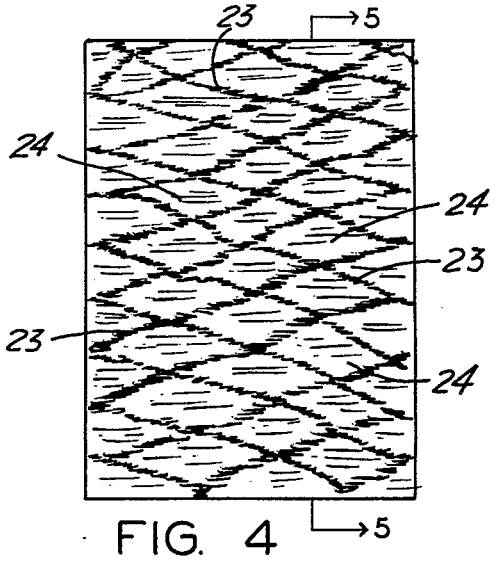
FIG. 4 is a plan view of a portion of a paper web creped by the method of our invention after it has been pressed with the pattern surface shown in FIG. 3.

For purposes of illustration, a portion of a pattern which can be carried by the pattern roller 19 is shown in FIG. 3. The crossing rippled portions 23*a* of the pattern shown in FIG. 3 are raised, with the isolated areas 24*a* of the pattern being depressed from the surface of the rippled portions a distance at least as great as the thickness of the web to be creped. After the web has been pressed with the pattern shown in FIG. 3 in accordance with our method, and has been creped off of the surface of the creping cylinder, the web takes on the patterned creped appearance shown illustratively in FIG. 4. The portions of the web which are pressed by the pattern roller adhere more strongly to the creping cylinder and crepe off of the creping cylinder surface in small folds which are closely packed together. These finely creped portions of the web are shown generally at 23 in the cross-sectional view shown in FIG. 5. The portions of the web which are not pressed are creped very coarsely, if at all, and are seen as puffed up areas between the areas of the web that are finely creped.

Figure 5:
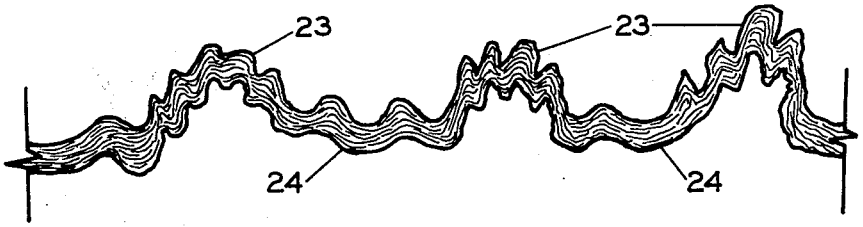
FIG. 5 is a cross-sectional view of the paper web portion shown in FIG. 4 taken along the line 5—5 in FIG. 4.

These puffed up areas are shown generally at 24 in FIG. 5. The difference in the size and frequency of the folds between those areas illustrated at 23 which are strongly adhered to the creping cylinder surface and those areas illustrated at 24 which are not strongly adhered results in the formation of the pattern appearance of the web shown in FIG. 4.

Figure 6:
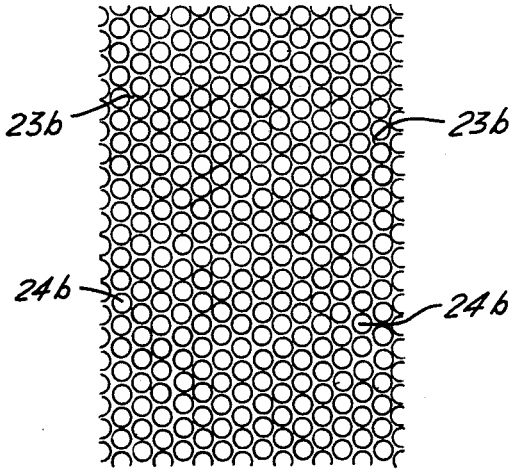
FIG. 6 is a plan view of a portion of another patten surface which can be used to provide pattern areas of pressure on a paper web.

Many other types of patterns having raised pattern surfaces may be employed on the pattern roller 19. An example of an alternative pattern is shown in FIG. 6, consisting of small staggered circles **24*b* which are depressed, with the interconnected areas 23*b* between the circles forming the elevated portion of the pattern. Again, the surface of the raised portions of the pattern preferably extends above the depressed portions a height that is at least as great as the thickness of the web to be pressed. A sample portion of a paper web pressed with this pattern and creped off of the creping cylinder is shown illustratively in FIG. 7. The resulting web shown in FIG. 7 has finely creped portions 23*c* corresponding to the portions of the web which were pressed and strongly adhered to the creping cylinder, whereas the open portions 24*c*** of the web with few or no folds correspond to those portions that were not pressed and were lightly adhered to the creping cylinder.

In another embodiment of our invention, the creping adhesive may be applied directly to the surface of the creping cylinder 17, with the web 11 being brought into contact with the adhesive on the surface of the creping cylinder. The contact between the web under tension and the surface of the creping cylinder causes a uniform adherence of the web to the creping surface. One apparatus for applying the creping fluid to the creping cylinder is shown in FIG. 1. A gravure cylinder 25 picks up adhesive fluid from a pan 26. A doctor blade 27 scrapes off the excess adhesive from the surface of the gravure cylinder to ensure that an even coat of adhesive is carried on to the surface of the creping cylinder. The adhesive fluid is picked off of the gravure cylinder 25 by a soft rubber offset roller 8 which then carries the adhesive fluid to the surface of the creping cylinder 17. The soft rubber roller 28 is capable of making firmer contact with the hard metal surface of the creping cylinder than would the hard surface of a gravure cylinder such as the gravure cylinder 25. The adhesive fluid applied by the offset roller 28 dries rapidly on the surface of the heated creping cylinder 17, but is still somewhat tacky when the pattern roller 19 presses the web 11 with the pattern on the surface thereof. Thus, those portions of the web which have been pressed by the raised portions of the pattern roller 19 are adhered more strongly to the surface of the creping cylinder 17, and a patterned creped web is obtained.

Another alternative for uniformly applying an adhesive between the web and the creping cylinder, not illustrated, is the spraying of a uniform coating of adhesive either onto the creping cylinder before adherence of the web, or onto the surface of the web prior to adherence to the cylinder.

Figure 2:
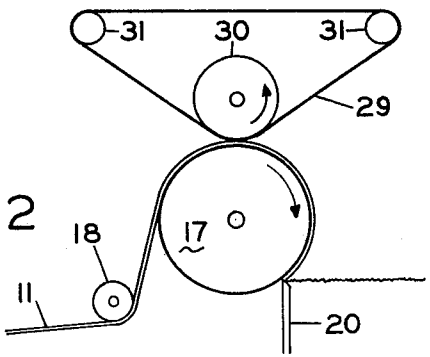
FIG. 2 is a schematic view of a portion of another embodiment of creping apparatus utilized in performing patterned creping.

The pattern area of pressure may alternatively be applied to the web 11 by means of a pattern perforated endless belt 29 as shown in FIG. 2. The flexible belt 29 has the desired pattern formed in it with open areas corresponding to those areas of the pattern roller 19 which would be depressed. The perforated belt 29 is pressed against the web by means of roller 30 which applies a desired amount of pressure against the belt 29 to cause the pressing of the raised pattern into the web toward the creping cylinder. As shown in FIG. 2, the pattern roller 29 is preferably freely supported for motion around the impression roller 30 by a pair of idler rollers 31 which maintain the belt 29 taut.

The following Examples are provided to further illustrate the application of our invention.

EXAMPLE 1

The creping process was performed on a 15.1 lb. per ream web which had been initially through-air-dried to about 93% solids by weight, and which had a fiber furnish of 90% Ontario hardwood kraft and 10% Ontario softwood kraft. The adhesive consisted of a cellulose-acrylonitrile copolymer having an initial viscosity of 185 centipoise (cps) and containing 1% adhesive solids and 99% water. As shown in FIG. 1, the adhesive was applied to the web with a rotogravure roller 13 engraved to 200 lines per inch and having quadrangular shaped cells with a depth of 0.0012 inch. Application of the adhesive rewet the web to approximately 81.1% solids by weight, with the adhesive solids being applied to the web at the rate of approximately 0.024 lb. of solid per ream. The pressure exerted on the web at the nip between the gravure roller 13 and the backup roller 16 was less than 10 lb. per linear inch along the length of the nip. After the adhesive had been uniformly applied to one side of the paper web, the web was brought into contact with the polished surface of a creping cylinder which was heated to a temperature of 200° F. The contact pressure was provided only by the tension of the web against the surface of the creping cylinder. The creping cylinder had a surface speed of 96 fpm and the speed of the wind-up reel was 71 fpm.

The pattern roller 19 was provided with a raised pattern on its surface, with the raised areas defining a staggered circle pattern as shown for illustration in FIG. 6. The pattern contained 112 open holes per square inch with 50% of the surface being depressed. The innerconnected raised portions **23*b* extended beyond the depressed circular portions 24*b* a distance greater than the thickness of the tissue web. The pressure exerted on the web by the raised pattern areas was about 85 average psi., and about 170 psi. in the raised pattern portons 23*b*** since the raised portions constituted about 50% of the surface areas.

Figure 7:
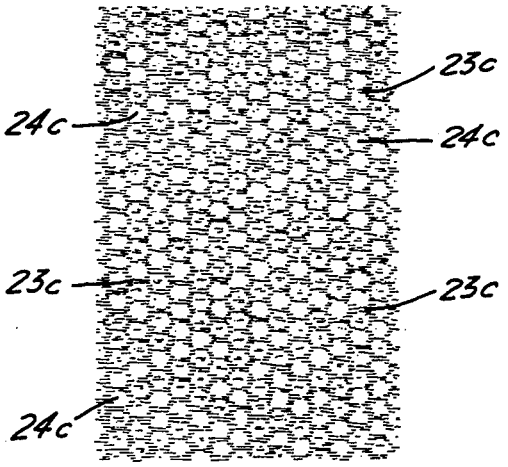
FIG. 7 is a plan view of a portion of a paper web creped by the method of our invention after it had been pressed with the pattern surface shown in FIG. 6.

The paper web was creped off of the creping cylinder surface by a creping blade applying 20 pli. to the creping surface, and the resulting creped pattern was similar to that shown illustratively in FIG. 7. The pattern in the web is defined by the differences in appearance between the more finely creped areas **23*c*, where the web was more firmly adhered to the surface of the creping cylinder, and the more coarsely creped areas 24*c*** corresponding to those areas which were not strongly adhered to the creping cylinder.

EXAMPLE 2

A 12.5 lb. per ream basis weight web which had been initially through-air-dried to about 93% solids by weight, and which had a fiber furnish of 90% Ontario hardwood kraft and 10% Ontario softwood kraft was provided for creping. Adhesive fluid as specified in Example 1 was uniformly applied to the surface of the creping cylinder 17 by a plain rubber offset roller 28 which had received the adhesive fluid from a gravure roller 25 partially immersed in a pan of adhesive fluid. The gravure roller was engraved to 150 lines per inch with the cells on the surface of the roller being quadrangular and having a cell depth of 0.0025 inch.

The paper web was brought into contact without pressure assistance with the surface of the creping cylinder, which was maintained at 200° F. Upon contact with the adhesive fluid on the cylinder, the web was rewet to approximately 90% solid by weight. Contact between the paper web and the creping surface was sufficient to cause uniform overall adhesion of the web to the creping surface.

The pattern roller 19 was provided with raised pattern areas defining a ripple pattern similar to that shown in FIG. 3, with the pattern having approximately ⅛ inch spacing between parallel ripple lines 23*a*. Approximately 55% of the surface area of the ripple pattern on the surface of the pattern roller was depressed and did not come into contact with the paper web. The raised surface areas 23*a* of the pattern roller applied approximately 85 average psi., and about 189 psi. in the raised pattern portions to the web at the nip between the pattern roller 19 and the creping cylinder 17. The creping doctor blade was set to apply 20 pli. against the surface of the creping cylinder, with the surface speed of the creping cylinder maintained at 100 fpm and the speed of the wind-up reel maintained at 67 fpm. After creping, the web had a patterned appearance similar to that shown illustratively in FIG. 4.

While the webs specified in Examples 1 and 2 are initially substantially dry in the range of 93% solids by weight, it should be recognized that wetter webs can also be pattern creped under the present invention. For example, a wetter web may be adhered to the creping cylinder with adhesive, pressed with the raised pattern, dried on the cylinder and creped off in the pattern. Further, a sufficiently wet web may adequately adhere to the creping cylinder even without the use of an additional adhesive. By initiating the creping process with a substantially dry web and by minimizing the rewetting of the web by the addition of the adhesive, the drying load placed on the creping cylinder or on any further drying means is diminished.

Many other types of adhesives can be utilized to provide additional adherence between the web and the surface of the creping cylinder if needed to obtain an adequate pattern creped web. Examples of other adhesive formulations which have been used successfully are acrylic latexes, styrene-butadiene latex, hydroxypropynethyl-cellulose, starch-polyacrylonitrile graft copolymer, and starch in solution with polyvinyl alcohol. The adhesive should be capable of drying on the surface of the creping cylinder and acquiring increased adhesion as it dries. Thus, pressure sensitive adhesives would not be suitable.

The amount of adhesive which must be applied between the web and the creping cylinder to obtain the proper and desirable creping depends upon such factors as the type and basis weight of the web, the consistency of the web onto the cylinder, the type of pattern pressing employed, and the speed of rotation of the cylinder. The patterned creping is a function of the differential adherence of the web to the cylinder, in that the unpressed regions of the web having lesser adhesion to the cylinder are creped differently from the pressed portions of the web having greater adhesion to the cylinder. A thicker or stiffer web will require a stronger adhesive or greater pressing to achieve the desired pattern creping. Faster creping surface speeds require faster drying stronger adhesives. A wetter web may require less additional adhesive since the inherent moisture may serve as an adhesive.

Various patterns can be used to press into the web to form regions of the web enclosed by compressed linear portions having directional components extending axially and circumferentially of the cylinder. In the pattern shown in FIG. 3, the crossing rippled portions 23*a* of the pattern press into the web and form corresponding crossing rippled linear portions of compressed web, with portions of the compressed web having directional components extending axially and circumferentially of the cylinder. Further, regions 24*a* of the web are unpressed and enclosed by the compressed linear portions.

Other possible patterns, in addition to that illustrated in FIG. 6, would include such patterns as a separated circular pattern. It is preferable that the raised portions of the pattern, which cause the web to be more strongly adhered to the creping surface, do not run parallel to or perpendicular to the direction of movement of the creping surface toward the creping blade in order to more distinctly obtain the creping pattern.

We claim:

1. A method of creping a fibrous web in a pattern having differing crepe characteristics comprising the steps of:

(a) uniformly adhering the fibrous web to a smooth creping cylinder without causing substantial compression of the web, (b) differentially adhering the web to the cylinder with regions of the web enclosed by linear portions having directional components extending axially and circumferentially of the cylinder, which portions have greater adhesion to the cylinder than said regions, by pressing into the web and toward the creping cylinder a raised pattern, and (c) creping the web by removing the web from the cylinder with a creping blade.

2. The method of claim 1 wherein the linear portions of the web having greater adhesion to the cylinder are uninterrupted.

3. The method of claim 1 including the step of uniformly applying an adhesive between the web and the creping cylinder to aid in the adhering of the web to the creping cylinder, wherein the total moisture content of the web including the moisture added by the adhesive does not exceed 20% by weight of the web.

4. A method of creping a substantially dry fibrous web in a pattern having differing crepe characteristics comprising the steps of:

(a) uniformly adhering the fibrous web to a smooth creping cylinder with the aid of an adhesive and without causing substantial compression of the web, (b) pressing a raised pattern into the web toward the creping cylinder, to form regions of the web enclosed by compressed linear portions having directional components extending axially and circumferentially of the cylinder, which portions have greater adhesion to the cylinder than said regions, and (c) creping the web by removing the web from the cylinder with a creping blade.

5. A creped fibrous web produced by the process of claim 4.

6. The method of claim 4, wherein the compressed linear portions of the web are uninterrupted.

7. A creped fibrous web produced by the process of claim 6.

8. The method of claim 6 wherein the total moisture content of the web including the moisture added by the adhesive does not exceed 20% by weight of the web.

9. A creped fibrous web produced by the process of claim 8.

10. In apparatus for producing a creped fibrous web, which apparatus includes a smooth creping cylinder, means for adhering a fibrous web to the creping cylinder, means for pressing portions of the adhered web, and a creping blade for creping the web by removing the web from the cylinder, the improvement which comprises:

raised pattern pressing means for forming regions of the web enclosed by linear portions which have greater adhesion to the cylinder than said regions, the pressing means comprising a surface for pressing into the web toward the creping cylinder a raised pattern having directional components extending axially and circumferentially of said cylinder.

11. The improvement of claim 10 wherein the surface for pressing into the web is contained upon a roller adjacent the web.

12. The improvement of claim 10 wherein the surface for pressing into the web is contained upon an endless belt adjacent the web.

13. The improvement of claim 10 wherein the means for adhering a fibrous web to the creping cylinder include means for uniformly applying an adhesive between the web and the creping cylinder to aid in the adhering of the web to the creping cylinder.

14. The improvement of claim 13 wherein the means for uniformly applying the adhesive includes an offset roll for applying a uniform coating of adhesive.

15. The improvement of claim 13 wherein the means for uniformly applying the adhesive includes spraying means for applying a uniform coating of adhesive.

* * * * *